United States Patent [19]

Mason

[11] Patent Number: 5,065,561

[45] Date of Patent: Nov. 19, 1991

[54] FORM WORK SYSTEM

[75] Inventor: Martin B. Mason, Danville, Calif.

[73] Assignee: American Construction Products, Inc., Campbell, Calif.

[21] Appl. No.: 260,165

[22] Filed: Oct. 19, 1988

[51] Int. Cl.[5] ..... E04B 2/00

[52] U.S. Cl. ..... 52/309.12; 52/426; 52/562; 52/379

[58] Field of Search ..... 52/379-381, 52/426-428, 699, 309.12, 562; 249/38, 40, 213, 217, 219.1

[56] References Cited

U.S. PATENT DOCUMENTS

| | | | |
|---|---|---|---|
| 1,924,724 | 8/1933 | Olney | 52/379 |
| 3,985,329 | 10/1976 | Liedgens | 249/40 |
| 4,765,109 | 8/1988 | Boeshart | 52/426 |

FOREIGN PATENT DOCUMENTS

| | | | |
|---|---|---|---|
| 2830028 | 1/1980 | Fed. Rep. of Germany | 249/40 |

*Primary Examiner*—James L. Ridgill, Jr.

*Attorney, Agent, or Firm*—Rosenblum, Parish & Bacigalupi

[57] ABSTRACT

A concrete wall form system including a plurality of first and second panels each preferably having grooved portions extending along corresponding top side edges and complementary mating tongue portions extending along corresponding bottom side edges, and having regularly spaced transverse slots extending into the top and bottom side edges thereof. The form system also includes a plurality of ties each having a bridging web portion, interior flanges formed at the opposite extremities of the web portions, and fastening portions also formed at each end of the web portion and including an outwardly extending shank terminating in an outer flange, the shanks of the fastening portions being adapted for disposition in the aligned transverse slots in vertically adjacent form panels, the interior flanges engaging an interior wall of the panels, and the exterior flanges engaging an outer side wall of the panels. In accordance with the present invention each horizontal row of ties holds together both the top edges of one course of panels and the bottom edges of another course of panels disposed immediately thereabove.

11 Claims, 11 Drawing Sheets

FORM WORK SYSTEM

BACKGROUND OF THE INVENTION

1. Field of the Invention

The present invention relates generally to form works for containing liquid concrete while it hardens, and more particularly to form works using bridge ties to connect opposing planar panels for forming concrete walls.

2. Prior Art

Form works made from plastic blocks connected by ties are well known in the construction industry for containing wet concrete as it dries. U.S. Pat. No. 3,788,020 observes that removal of forms requires considerable time, and teaches away from the use of removable wall forms by describing polystyrene panel-blocks interconnected by ties which keep the panels in place after they have served the purpose of containing wet concrete. In that patent, as noted by U.S. Pat. No. 4,655,014, using tie members fitted into pre-formed slots or grooves in the side walls results in the side walls being considerably weakened, and accordingly provides dovetail interface joints for connecting ties to the insides of wall forming panels. U.S. Pat. No. 4,706,429 describes ties with T-shaped ends which slide into polystyrene panel slots with shoulders underneath to absorb potential shocks to the panels when wet concrete is dumped into the form. U.S. Pat. No. 4,730,422 provides a similar system of ties and panels with indicia marks on the outer sides of the panels over tie ends hidden inside the panels as guides for sinking anchors for additional wall coverings, but the indicia marks do not necessarily assure that screws or other anchors will penetrate directly into tie ends.

The above prior art seeks to make more convenient and stronger form systems by using ties which become permanently imbedded in both the concrete and in the side panels. Once cemented in place, the panels cannot normally be removed if desired to expose the concrete inside.

SUMMARY OF THE INVENTION

Briefly, preferred embodiments of form systems according to the invention include first and second panel means each preferably having grooved portions along two adjacent side edges and complementary tongue portions along the other two adjacent side edges and having rows of regularly spaces slots. The form systems also include tie means having bridge means with web means the opposite first and second ends of which form respective interior flanges, and having first and second fastening means each with shank means for extending through a form panel from an interior end coupled to the side of a respective interior flange away from said web means to an exterior end, and with exterior flange means coupled to the exterior end of said shank means for supporting the outer side of a form panel.

Among the advantages of the invention is that the exterior flanges provide better support for the form panels. The exterior flanges also facilitate anchoring screws or nails for additional wall coverings. Alternatively, the exterior flanges, shanks and interior flanges can be broken off and removed from the finished wall, which allows the form panels to be removed as well.

DETAILED DESCRIPTION OF THE PREFERRED EMBODIMENTS

Figure 1:
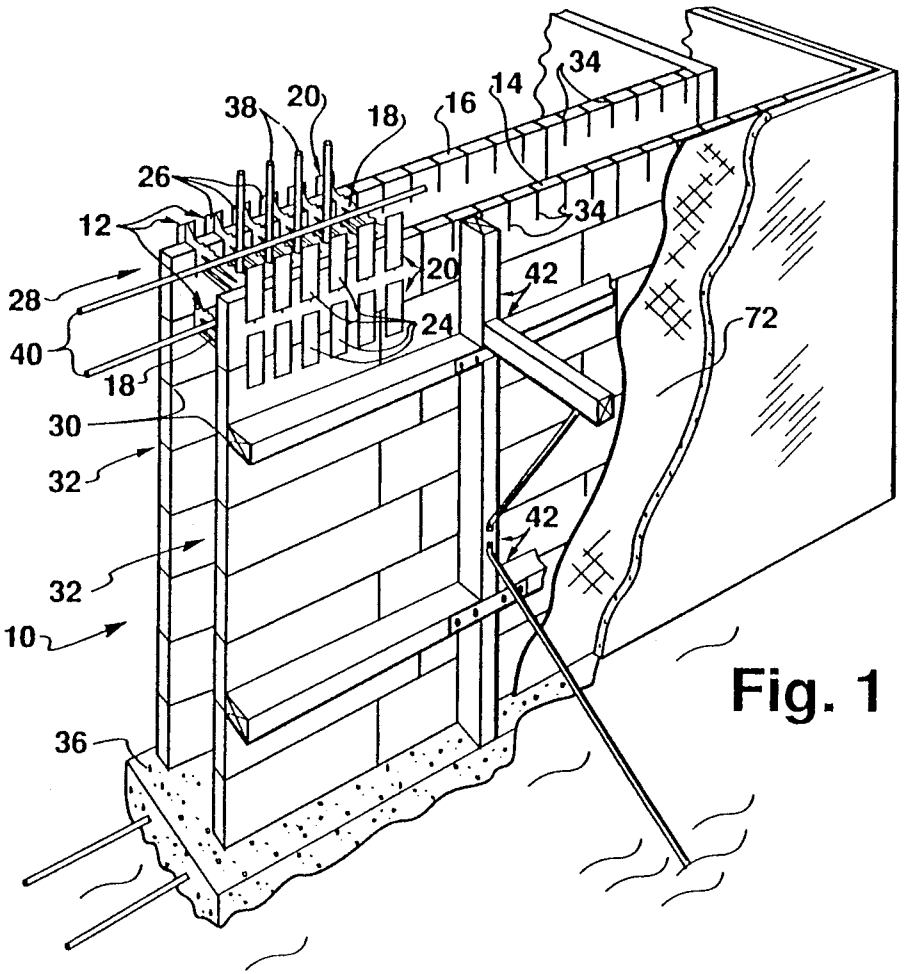
FIG. 1 is a perspective view of a form system including ties and panels for forming concrete walls according to the present invention.

FIG. 1 shows a form system 10 according to the present invention using tie means 12 to space apart parallel planar panels 14 and 16. Each tie 12 includes a bridge 18 coupled on opposite ends to fasteners 20 and 22 which extend entirely through panels 14 or 16 to exterior flanges 24 and 26. Courses 28 of ties 12 are positioned across a space 30 and alternated with courses 32 of panels 14 and 16 on opposite sides of space 30. In each course ties 12 are positioned in a row of slots 34 evenly spaced in edges of panels on one side and in a corresponding row of equally spaced slots 34 in panels on the opposite side. The height of the ties 12 is approximately twice the depth of edge slots 34, so that half of the tie fits into a slot in the course 32 of panels below while the other half fits into a slot in the course of panels above, whereby ties straddle interfaces between horizontal edges of upper and lower panels, which are preferably staggered. The exterior flanges 24, 26 of this invention provide better support for the more or less deformable side wall panels 14 and 16 than do prior art ties.

Typically, form system 10 is installed on a foundation such as footer 36 which fixes vertical steel reinforcement bars (rebar) 38, and horizontal rebar 40 is secured across ties 12 in each course 28. External shoring or bracing 42 can be used to assist in preventing form system 10 from tilting over while or after being filled with wet concrete.

Figure 2:
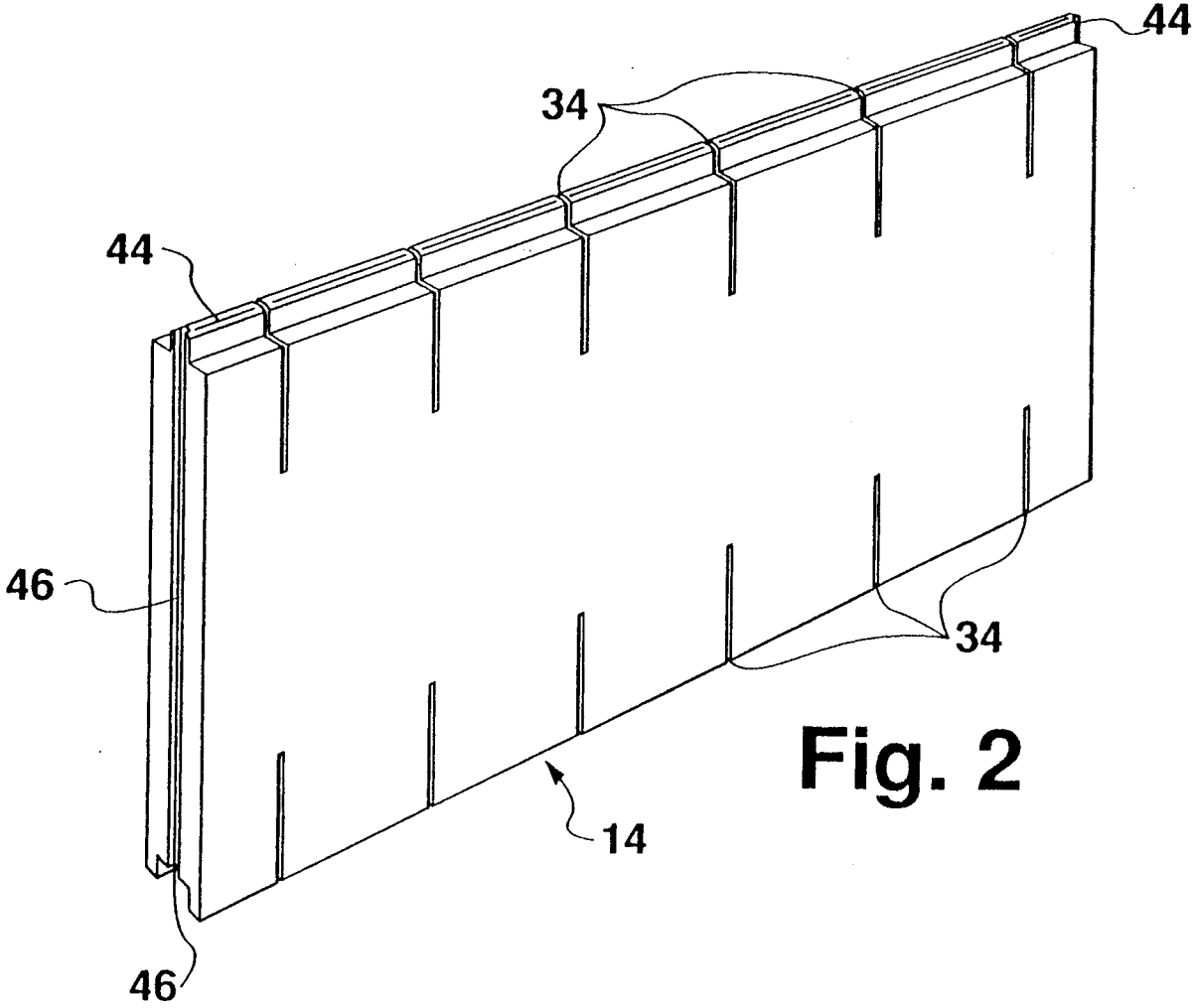
FIG. 2 is an isometric view of the preferred thick panel form in systems according to the present invention.

FIG. 2 show a thick panel 14 formed of expanded polystyrene foam (EPS) which is impervious to concrete. Panel 14 has two adjacent side edges with tongue portions 44 and two opposite adjacent side edges with complementing grooved portions 46 to lock neighboring panels 14 together. Panel 14 may for example be one foot high by four feet long by two inches thick, with lengthwise side edges each having six slots 34 spaced eight inches apart and four inches from the ends.

Figure 3:
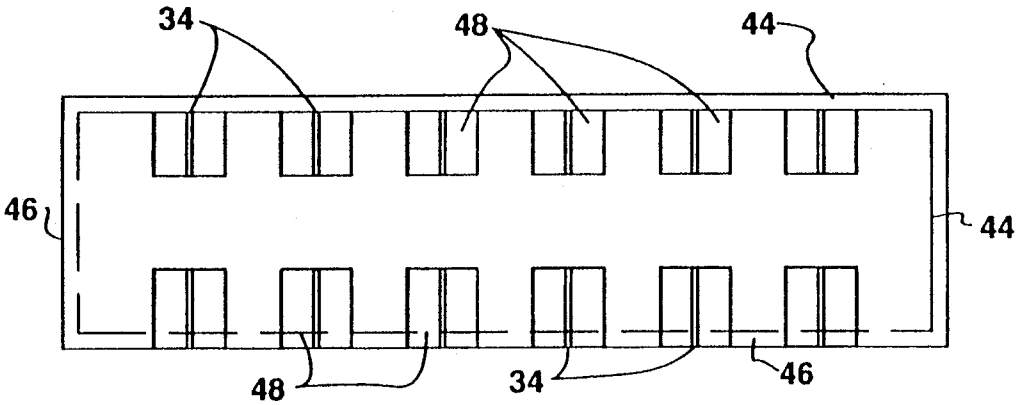
FIG. 3 is a plan view of the exterior side of a thick panel embodiment having counter-sunk areas for receiving exterior flanges flush with the surface of the panel.

FIG. 3 shows a panel 15 in an embodiment in which the outside surface has recessed areas 48 for receiving tie flanges 24 or 26 flush with the rest of the outside surface.

Figure 4:
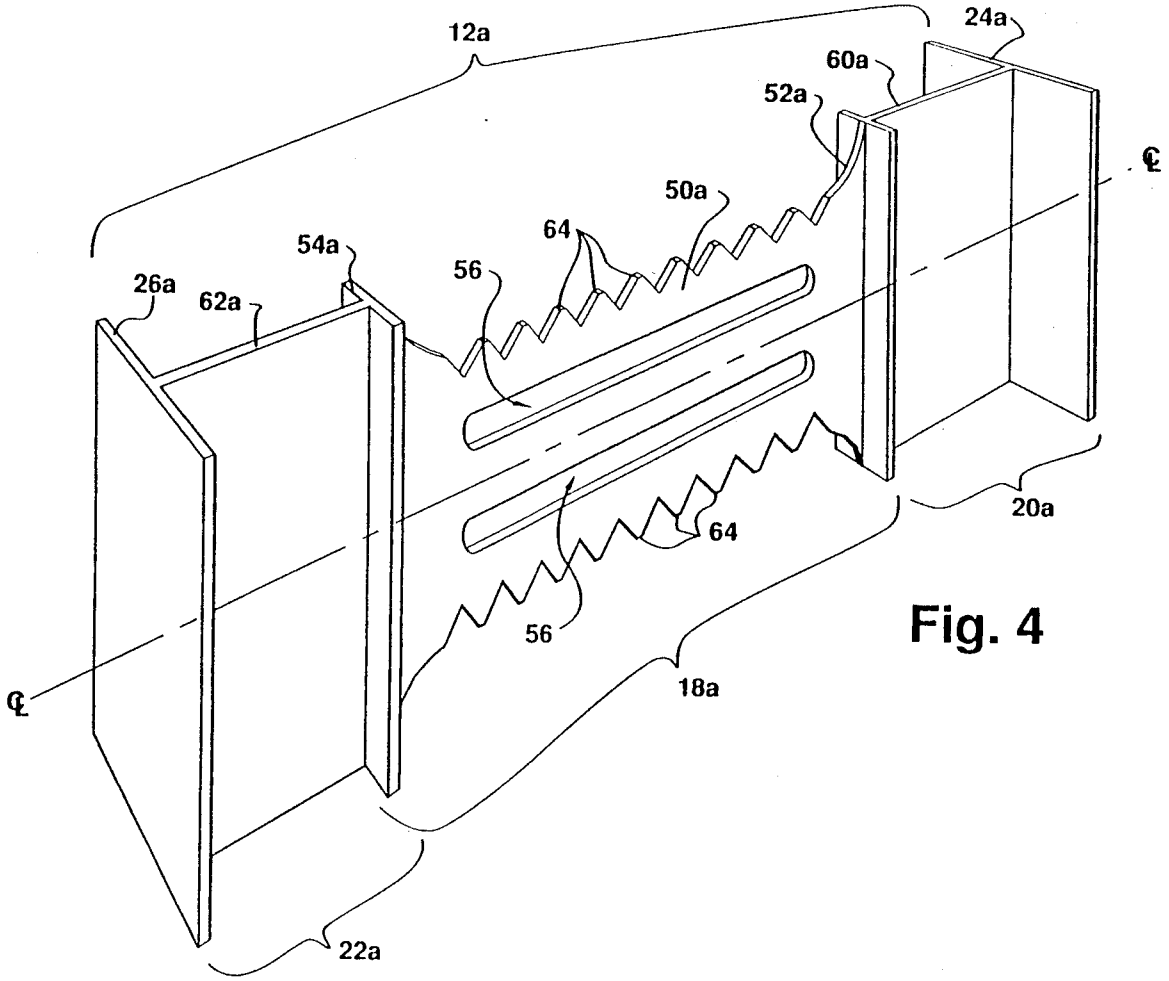
FIG. 4 is an isometric view of tie means in a first embodiment including a bridge and integral fastening means including a shank and exterior flange.

Referring to FIG. 4, tie means 12*a* in a first embodiment includes bridge means 18*a*, first fastening means 20*a* and second fastening means 22*a*. Bridge means 18*a* includes a generally planar web 50*a* with opposite vertical sides forming interior flanges 52*a* and 54*a*. Web 50*a* preferably has at least one port hole 56 through which concrete can flow to embed web 50*a* in a wall 58. Bridge means 18*a* may be for example six to twelve inches long. Each fastening means 20*a* and 22*a* includes a shank 60*a* or 62*a* with one end coupled to a respective interior flange (52*a* or 54*a*) and an opposite end coupled to an exterior flange 24*a* or 26*a*. In this embodiment both shanks 60*a* and 62*a* are proportioned to fit through thick panels 14. The exterior flanges are for example two and three-quarters inches wide and ties 12 at their highest point are for example five and one-half inches high. Web means 50 preferably has notches 64 along both horizontal edges so that the tie is symmetrical and can be used with either notched edge up. However, the bottom and top courses in wall 58 use base tie means comprising half of the bridge 18 and fastening means 20, 22 above or below longitudinal center line CL with notches 64 along only one horizontal edge.

Figure 5:
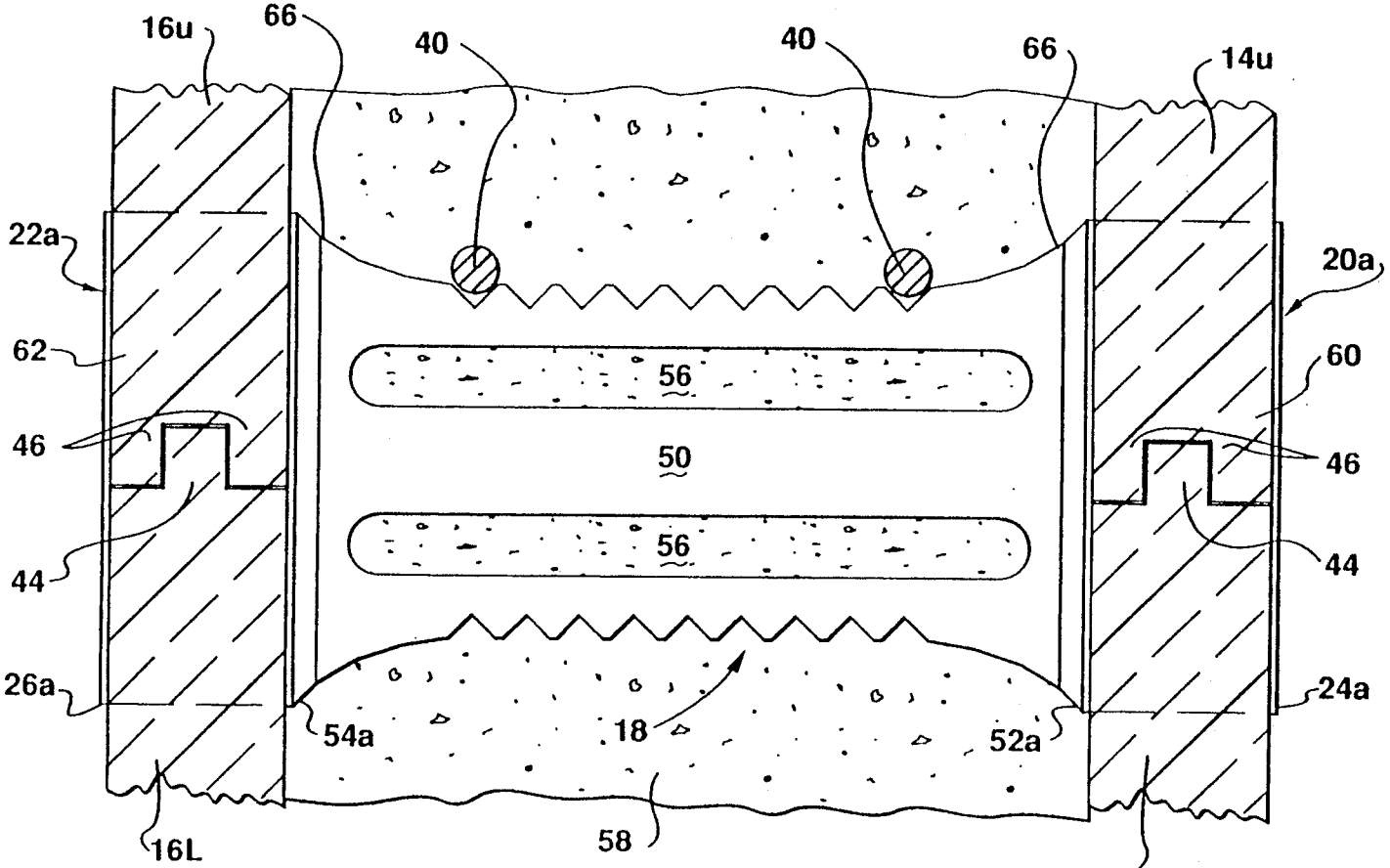
FIG. 5 is a vertical cross-section through a concrete wall showing the FIG. 4 tie means holding thick panel forms on opposite sides of the wall.

FIG. 5 shows bridge 18*a* embedded in a concrete wall 58 between fastening means 20*a* and 22*a* with shanks 60*a* and 62*a* extending through thick foam panels 14U, 14L and 16U, 16L to exterior flanges 24*a* and 26*a*, respectively. Upper right and left panels 14U and 16U have side edges with grooved portions 46 and lower right and left panels 14L and 16L have complementary tongue portions 44 which mate with each other. Web 50 is preferably weakened by thinning along score line 66 so that, if desired, once the wet concrete has dried interior flanges 52*a*, 54*a* and fastening means 20*a*, 22*a* can be broken away from web 50 and removed from wall 58.

Figure 6:
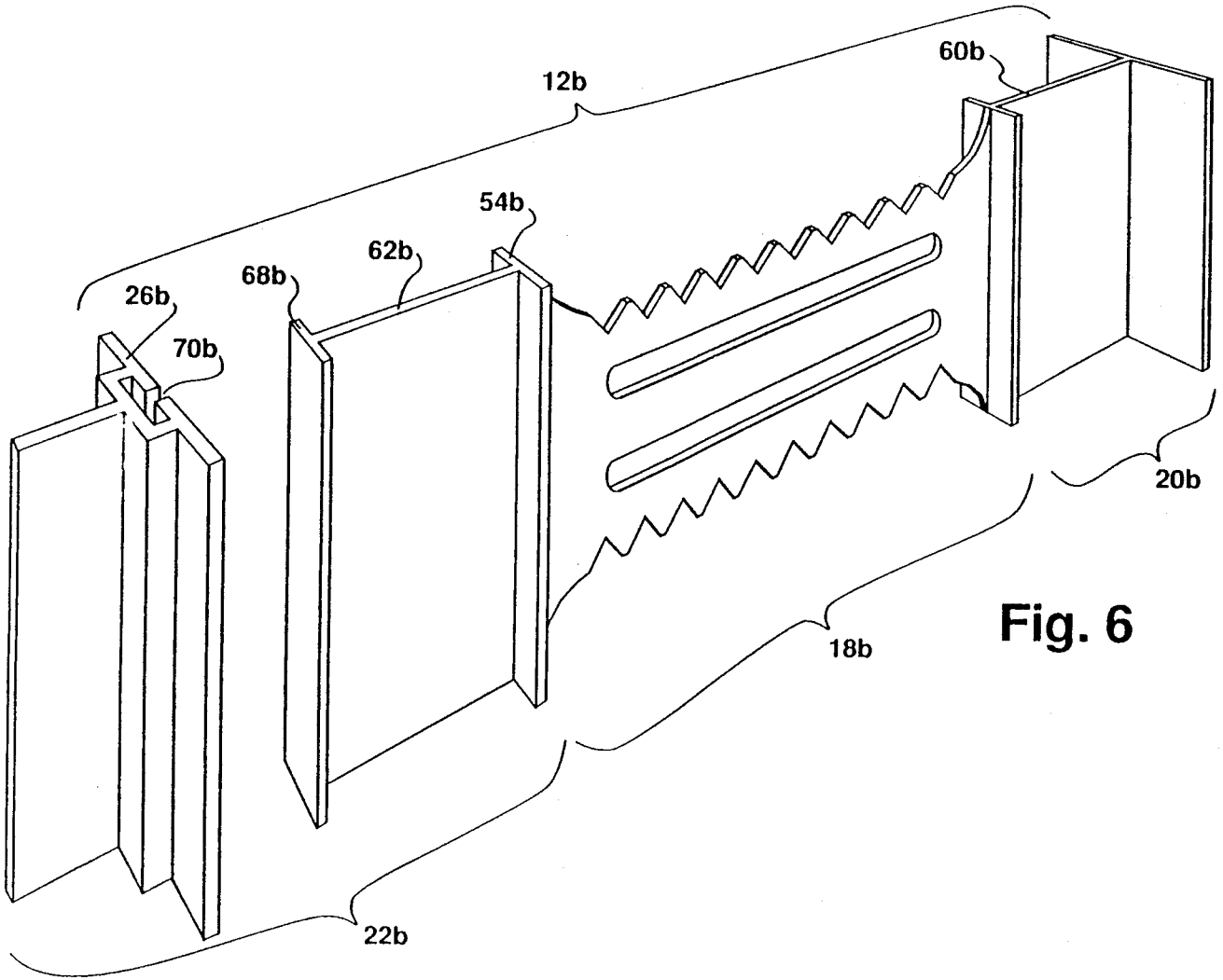
FIG. 6 is an isometric view of tie means in a second embodiment including a bridge and fastening means in which a shank for traversing a thick panel extends from the bridge's interior flange to a coupling flange, and the exterior flange is a separate clip.

FIG. 6 shows a second embodiment of tie means 12*b* with one end of bridge 18*b* extending beyond interior flange 54*b* to form a shank 62*b* which ends in a coupling flange 68*b* for insertion from the inside outward through a hole (not shown) in a thick panel 14. In fastening means 22*b* the exterior flange is a separate clip 26*b* having a coupling socket 70*b* for engaging coupling flange 68*b*This and the following embodiments allow form works to be put up one side at a time. Courses 28 of ties 12*b* are positioned with thick panels fastened by the integral shanks 60*b* on one end of the bridges, and then panels with slots are pushed onto shank 62*b* ends without integral exterior flanges on the other end of the bridges. Next, clips 26*b* are slid onto the coupling flanges 68 protruding from the second side 16 of the wall. This has the advantage of maintaining full access to the rebar 38, 40 while successive courses 32 of panels are stacked on one side.

Figure 7:
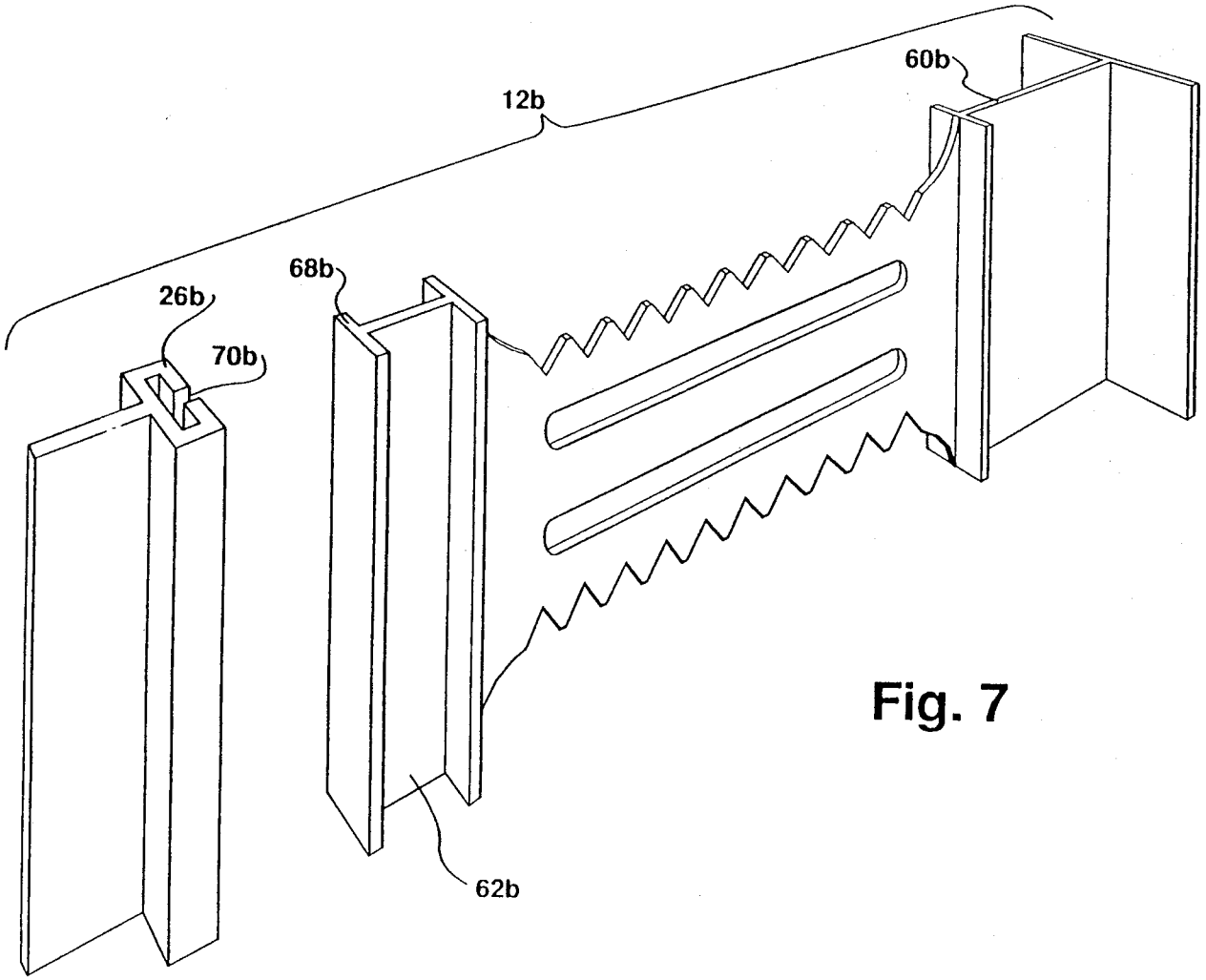
FIG. 7 is an isometric view of tie means similar to FIG. 6 in the second embodiment with a shank for holding a thin panel form.

FIG. 7 shows the second embodiment of tie means 12*b* with a shank 62*b* proportioned to fit through a hole in a thin (preferably plywood) panel (not shown). This embodiment maintains full access to the rebar and facilitates stripping the plywood panels from one side of the finished concrete wall 58.

Figure 8:
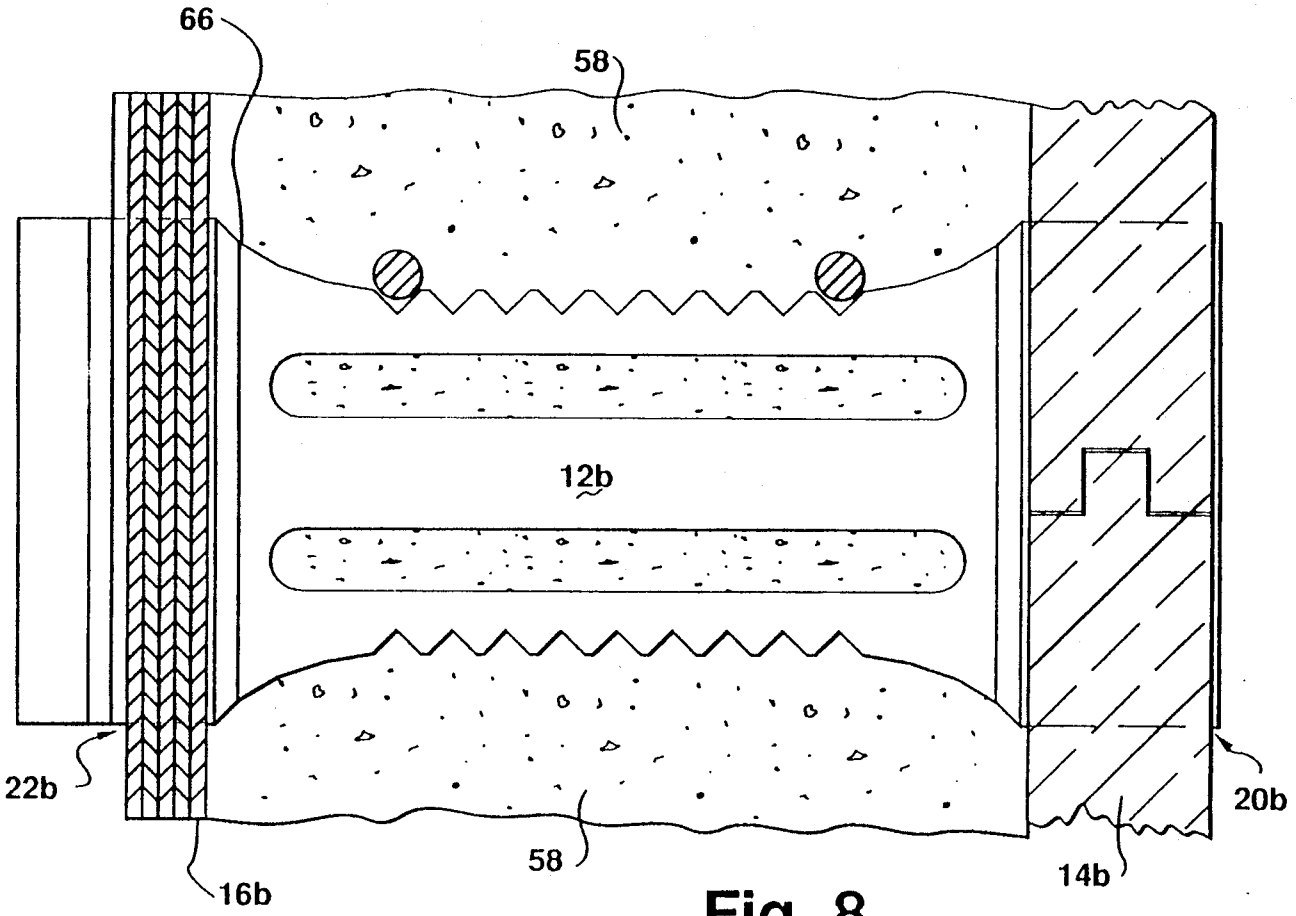
FIG. 8 is a vertical cross-section through a concrete wall showing the FIG. 7 tie holding a thin panel on one side of the wall and a thick panel on the other side.

FIG. 8 shows the FIG. 7 tie means embedded in a concrete wall 58 between fastening means 22*b* holding a thin pan 16*b* and fasteningmeans 20*b* holding a thick panel 14*b*.

Figure 9:
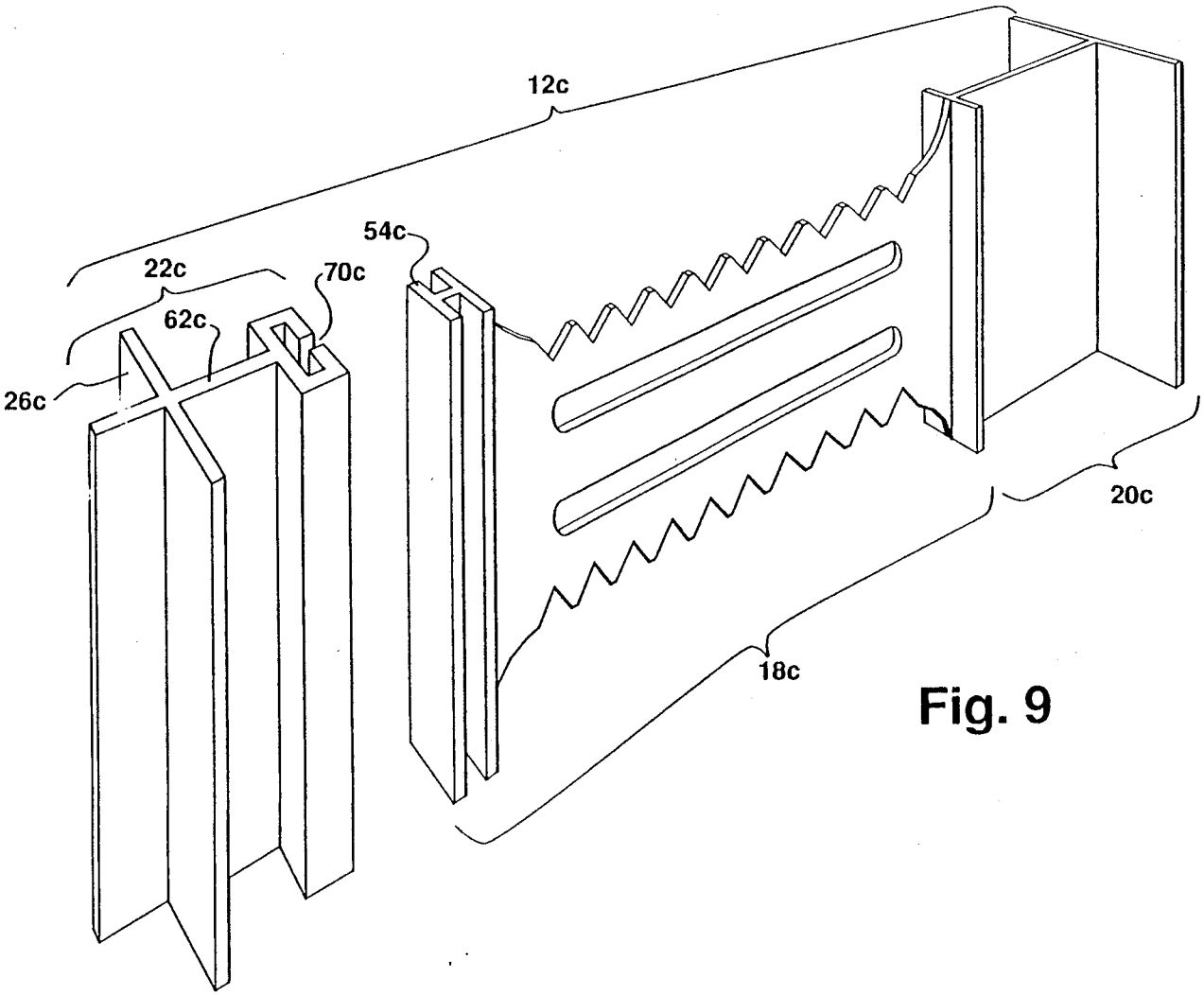
FIG. 9 is an isometric view of tie means in a third embodiment in which the fastening means is an integrally formed exterior flange and shank for holding thick panels and is separate from the bridge means.

FIG. 9 shows tie means 12*c* in a third embodiment in which one fastening means 22*c* includes an integrally formed shank 62*c* and an exterior flange 26*c* separate from bridge means 18*c*. Shank 62*c* has a socket 70*c* which couples to interior flange 54*c*.

Figure 10:
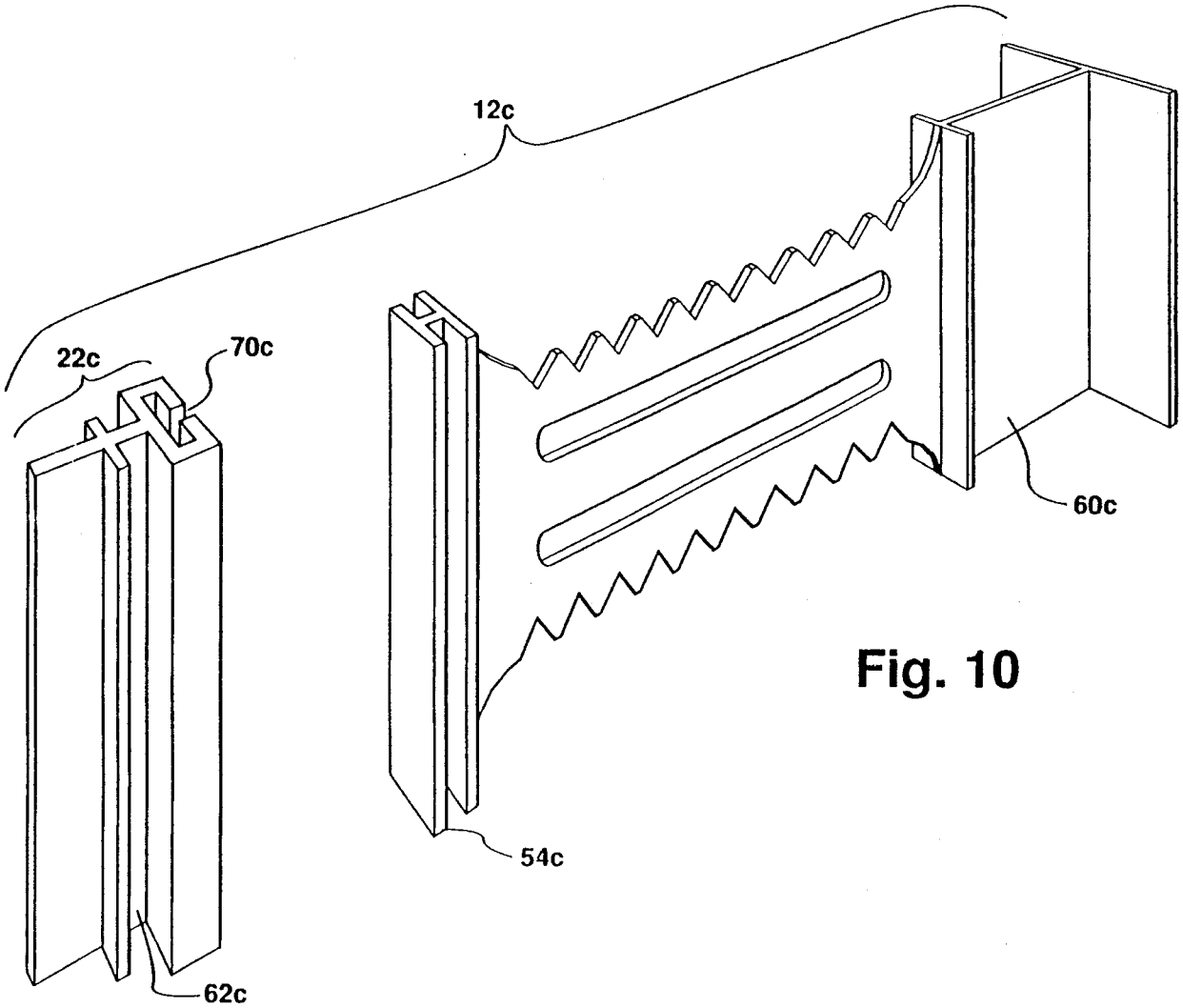
FIG. 10 is an isometric view of tie means in a third embodiment similar to FIG. 9 for use holding between edges of thin panels.
Figure 12:
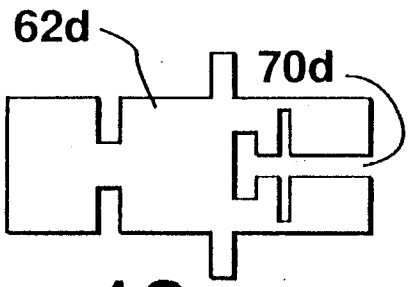
FIG. 12 is a top view of the fastening means of FIG. 11.
Figure 13:
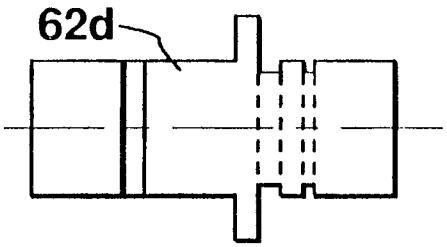
FIG. 13 is a side view of the fastening means of FIG. 11.
Figure 14:
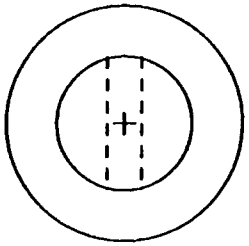
FIG. 14 is an end view of the fastening means of FIG. 11.
Figure 15:
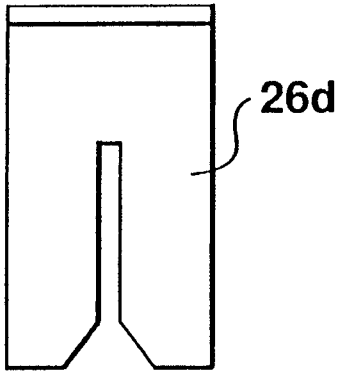
FIG. 15 is a plan view of the exterior flange of FIG. 11.
Figure 16:
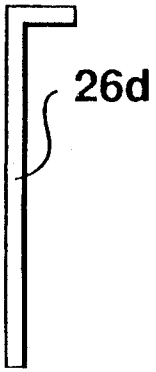
FIG. 16 is a side view of the exterior flange of FIG. 15.

FIG. 10 shows the third embodiment of tie means 12*c* with separate fastening means 22*c* including a shank 62*c* proportioned to hold a thin panel. Sheets of plywood higher than a single course 32 of thick panels 14 may be used by providing a row of slots 34 in the plywood at the level of each course 28 of ties, inserting shanks 62*c* through slots in the row for the current course 28, then sliding interior flanges down into the coupling sockets 70*c* of the fastening means while sliding shanks 60*c* on the other ends of the ties into slots in thick panels. The process is repeated for the next course 32 of thick panels using the next row of slots in the same large sheet of plywood.

Figure 11:
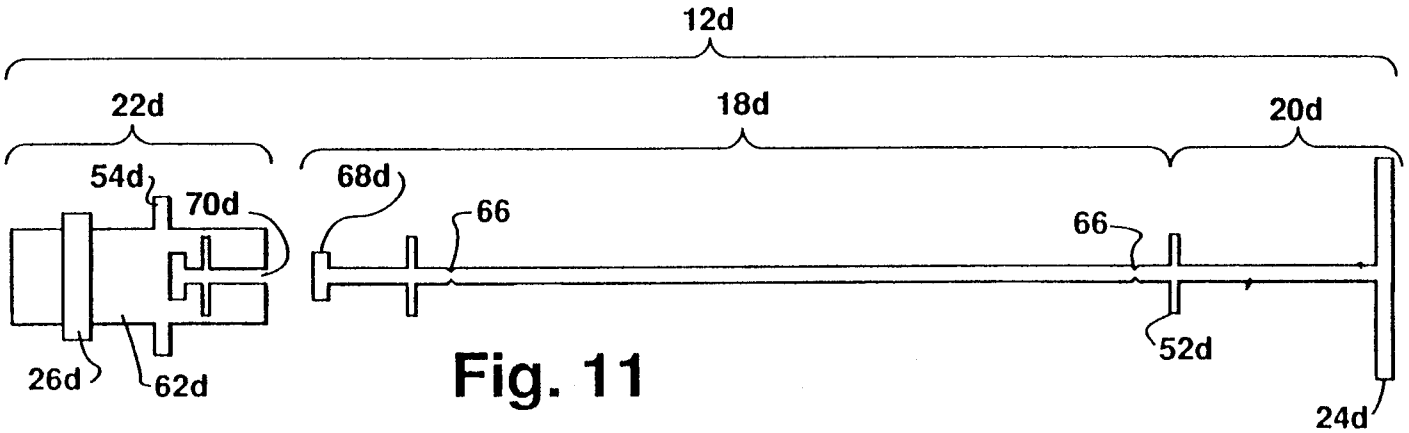
FIG. 11 is a top view of tie means in a fourth embodiment in which the bridge means is separate from the fastening means, the shank has a socket which couples to the interior flange, and the exterior flange is a separate pin or clip.

FIG. 11 is a top view of a tie means 12*d* in accordance with a fourth embodiment in which fastening means 22*d* is separate from bridge means 18*d*. As shown in FIGS. 12 through 16, fastening means 22*d* includes a shank 62*d* with a socket 70*d* for coupling to interior flange 54*d* and includes a separate exterior flange in the form of a pin or clip 26*d* which engages slots in the distal end of the shank. Shank 62*d* may be inserted from the inside outward through a round hole in a central area (not at an edge) of a large plywood panel and clipped in place by exterior flange pin 26*d* on the outside of the plywood panel before courses 32 of thick panels are installed on the opposite side similarly to the embodiment of FIG. 10.

To build a concrete wall 58 in a space 30 over a concrete footer 36, courses of side panels 14 and 16 and interleaved courses of ties 12 are stacked to a selected height (not necessarily the top of the wall). The ends of space 30 are closed by suitable means (not shown), and space 30 is filled with wet concrete, which gradually sets and dries to form wall 58.

Once the concrete has hardened into wall 58, panels 14 and 16 may be left in place to provide thermal and acoustic insulation or to anchor backings 72 (FIG. 1) such as lath for a later application of stucco. Unlike conventional form systems, ties 12 according to this invention with exterior flanges 24, 26 provide readily accessible bases to anchor screws or nails for holding furring strips. Furthermore, it is convenient if desired to break off the exterior flanges 24 and/or 26, shanks 60, 62 and interior flanges 52, 54 along score lines 66 in web 50 and then if desired to remove either or both side panels 14 and 16 and reveal the concrete wall 58 inside.

While the present invention has been described in terms of several preferred embodiments, it will be appreciated by those skilled in the art that these embodiments may be modified without departing from the essence of the invention. It is therefore intended that the following claims be interpreted as covering any modifications falling within the true scope and spirit of the invention.

I claim:

1. Wall form apparatus for forming wet concrete into walls, comprising:

a plurality of vertically stackable rectangularly configured panels having interlocking edges and adapted to form a pair of parallel, spaced-apart wall forms, said panels each having a plurality of tie-receiving transversely oriented slots formed along regular intervals at the top and bottom edges thereof, said slots extending vertically a and bottom edges thereof, said slots extending vertically a predetermined distance into the top and bottom edges of said panels; and a plurality of tie means, each including an elongated bridge portion spanning between first and second shank portions, transversely extending interior flange means formed at the junctions of said bridge portions and said shank portions, and exterior flange means disposed at the distal ends of said shank portions, said shank portions having vertical dimensions substantially equal to twice said predetermined distance whereby when the lower halves of said shank portions are mated with corresponding slots in the top edges of two parallel spaced apart panels, the upper halves thereof extend above said panels such that additional panes may be stacked thereabove with their lower edge slots disposed in mating relationship with said upper halves, said interior flange means and exterior flange means being adapted to engage the interior and exterior faces respectively of said panels.

2. Wall form means as recited in claim 1 wherein at least one of said exterior flange means includes a coupling flange and a separate clip for coupling to said coupling flange.

3. Wall form means as recited in claim 1 wherein said panel means have grooved portions along two adjacent side edges and have complimentary tongue portions along the other two adjacent side edges.

4. Wall form means as recited in claim 1 wherein both said shank means are integral extensions from the outer sides of respective interior flanges.

5. Wall form means as recited in claim 4 wherein both said exterior flange means are formed integral with the respective shank means.

6. Wall form means as recited in claim 1 wherein at least one of said shank portions is separate from said bridge means and has a coupling socket for coupling to the corresponding interior flange means.

7. Wall form means as recited in claim 6 wherein at least one of said exterior flange means is formed integral with the adjacent shank portion.

8. Wall form means as recited in claim 6 wherein at least one of said shank portions has interlocking means on its exterior end, and said exterior flange means is a locking clip for engaging with said interlocking means.

9. Wall form means as recited in claim 1 wherein said bridge means defines at least 1 port hole through which liquid concrete can flow.

10. Wall form means as recited in claim 9 wherein said bridge means has notches for seating reinforcement bars along at least one side edge.

11. Wall form means as recited in claim 10 wherein said bridge means has said notches along only one horizontal side edge.

* * * * *